US005878310A

United States Patent [19]

Noda et al.

[11] Patent Number: 5,878,310

[45] Date of Patent: Mar. 2, 1999

[54] PROCESS CARTRIDGE, ASSEMBLING METHOD FOR PROCESS CARTRIDGE AND ELECTROPHOTOGRAPHIC IMAGE FORMING APPARATUS

[75] Inventors: Shinya Noda; Yoshikazu Sasago, both of Toride; Haruhisa Oshida, Hatogaya; Toshiyuki Karakama, Tokyo; Shigeo Miyabe, Numazu, all of Japan

[73] Assignee: Canon Kabushiki Kaisha, Tokyo, Japan

[21] Appl. No.: 677,394

[22] Filed: Jul. 9, 1996

[30] Foreign Application Priority Data

Jul. 11, 1995 [JP] Japan ..... 7-199190

[51] Int. Cl.[6] ..... G03G 21/16

[52] U.S. Cl. ..... 399/117; 399/113; 399/167

[58] Field of Search ..... 399/117, 116, 399/113, 167; 492/16, 60, 15

[56] References Cited

U.S. PATENT DOCUMENTS

| | | | |
|---|---|---|---|
| 4,040,157 | 8/1977 | Shanly | 399/117 |
| 4,120,576 | 10/1978 | Babish | 399/117 |
| 4,527,883 | 7/1985 | Kamiyama | 399/117 |
| 4,639,119 | 1/1987 | Isaka | 399/113 |
| 4,943,828 | 7/1990 | Manabe et al. | 355/200 |
| 5,130,751 | 7/1992 | Sato et al. | 355/211 |
| 5,294,960 | 3/1994 | Nomura et al. | 399/113 |
| 5,331,373 | 7/1994 | Nomura et al. | 355/200 |
| 5,345,294 | 9/1994 | Nomura et al. | 355/200 |
| 5,452,056 | 9/1995 | Nomura et al. | 355/200 |
| 5,457,520 | 10/1995 | Schell et al. | 355/213 |
| 5,463,446 | 10/1995 | Watanabe et al. | 355/200 |
| 5,488,459 | 1/1996 | Tsuda et al. | 355/211 |
| 5,500,714 | 3/1996 | Yashiro et al. | 355/200 |
| 5,528,343 | 6/1996 | Tada et al. | 399/113 |
| 5,537,187 | 7/1996 | Sekine | 355/200 |

*Primary Examiner*—R. L. Moses

*Attorney, Agent, or Firm*—Fitzpatrick, Cella, Harper & Scinto

[57] ABSTRACT

A process cartridge detachably mountable to a main assembly of an electrophotographic image forming apparatus includes a cartridge frame; an electrophotographic photosensitive drum having a cylinder and a photosensitive layer thereon; a process device actable on the photosensitive drum; a drum shaft for rotatably supporting the photosensitive drum on the cartridge frame, the drum shaft extending through the photosensitive drum and having a length sufficient to be supported by the cartridge frame at one end thereof and at the other end thereof wherein the drum shaft is provided on its outer periphery adjacent its one end with projections and recesses, and is engaged with a hole in the cartridge frame; and a preventing member for preventing the drum shaft from disengaging from the cartridge frame.

46 Claims, 11 Drawing Sheets

PROCESS CARTRIDGE, ASSEMBLING METHOD FOR PROCESS CARTRIDGE AND ELECTROPHOTOGRAPHIC IMAGE FORMING APPARATUS

FIELD OF THE INVENTION

The present invention relates to a process cartridge, an assembling method for the process cartridge, and an electrophotographic image forming apparatus. More particularly, it relates to a process cartridge which is detachably mountable relative to the main assembly of an electrophotographic image forming apparatus such as a laser beam printer, electrophotographic copying machine or facsimile machine, and an electrophotographic image forming apparatus using the same.

DESCRIPTION OF THE RELATED ART

An image forming apparatus using an electrophotographic process is known which is used with the process cartridge. This is advantageous in that the maintenance operation can be, in effect, carried out by the users thereof without expert service persons, and therefore, the operativity can be remarkably improved. Therefore, this type is now widely used.

Here, an electrophotographic photosensitive drum used with the process cartridge has an electroconductive base of cylindrical configuration and a photosensitive layer thereon, and a flange having a gear or the like mounted to the end portion thereof by bonding or crimping or the like. The drum is rotatably supported in a cartridge by a support shaft mounted at a predetermined position in the cartridge frame. By the mounting operation, the positioning relative to the other member in the cartridge such as a cleaning blade, receptor sheet, developing roller charging roller or the like, is accomplished.

SUMMARY OF THE INVENTION

Accordingly, it is a principal object of the present invention to provide a process cartridge, assembling method of the process cartridge and an image forming apparatus to which the process cartridge is detachably mountable, wherein friction between a drum shaft and a drum shaft supporting frame is increased.

It is another object of the present invention to provide a process cartridge, an assembling method for the process cartridge and an electrophotographic image forming apparatus wherein the rigidity of the shaft support for the electrophotographic photosensitive drum can be increased.

It is a further object of the present invention to provide a process cartridge, an assembling method for the process cartridge and an electrophotographic image forming apparatus, wherein the drum shaft is improved.

It is a further object of the present invention to provide a process cartridge, an assembling method for the process cartridge, and an electrophotographic image forming apparatus, wherein the electrophotographic photosensitive drum is supported by a penetrating shaft.

According to an aspect of the present invention, there are provided a process cartridge, an assembling method for the process cartridge and an electrophotographic image forming apparatus, wherein a process cartridge detachably mountable to a main assembly of an electrophotographic image forming apparatus includes, a cartridge frame; an electrophotographic photosensitive drum having a cylinder and a photosensitive layer thereon; process means for acting on the photosensitive drum; a drum shaft for rotatably supporting the photosensitive drum on the cartridge frame, the drum shaft extending through the photosensitive drum and having a length sufficient to be supported by the cartridge frame at one end thereof and at the other end thereof wherein the drum shaft is provided on its outer periphery adjacent its one end with projections and recesses, and is engaged with a hole in the cartridge frame; and a preventing member for preventing the drum shaft from disengaging from the cartridge frame.

According to the present invention, the support shaft for the electrophotographic photosensitive drum has a length sufficient to penetrate the electrophotographic photosensitive drum and the cartridge frame, and therefore, the rigidity of the shaft support for the electrophotographic photosensitive drum increases, so that the perpendicularity of the image is maintained even if the electrophotographic photosensitive drum receives the driving force from the device main assembly, since the axis is not deviated. The vibration during the rotation of the electrophotographic photosensitive drum is prevented, so that a satisfactory image free of pitch non-uniformity can be provided.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

First Embodiment

The description will be made as to an embodiment of an electrophotographic image forming apparatus using the present invention in conjunction with the accompanying drawings. In the following embodiment, a laser beam printer is taken as an example of the electrophotographic image forming apparatus. The laser beam printer can be loaded with a process cartridge, as will be described hereinafter.

Figure 5:
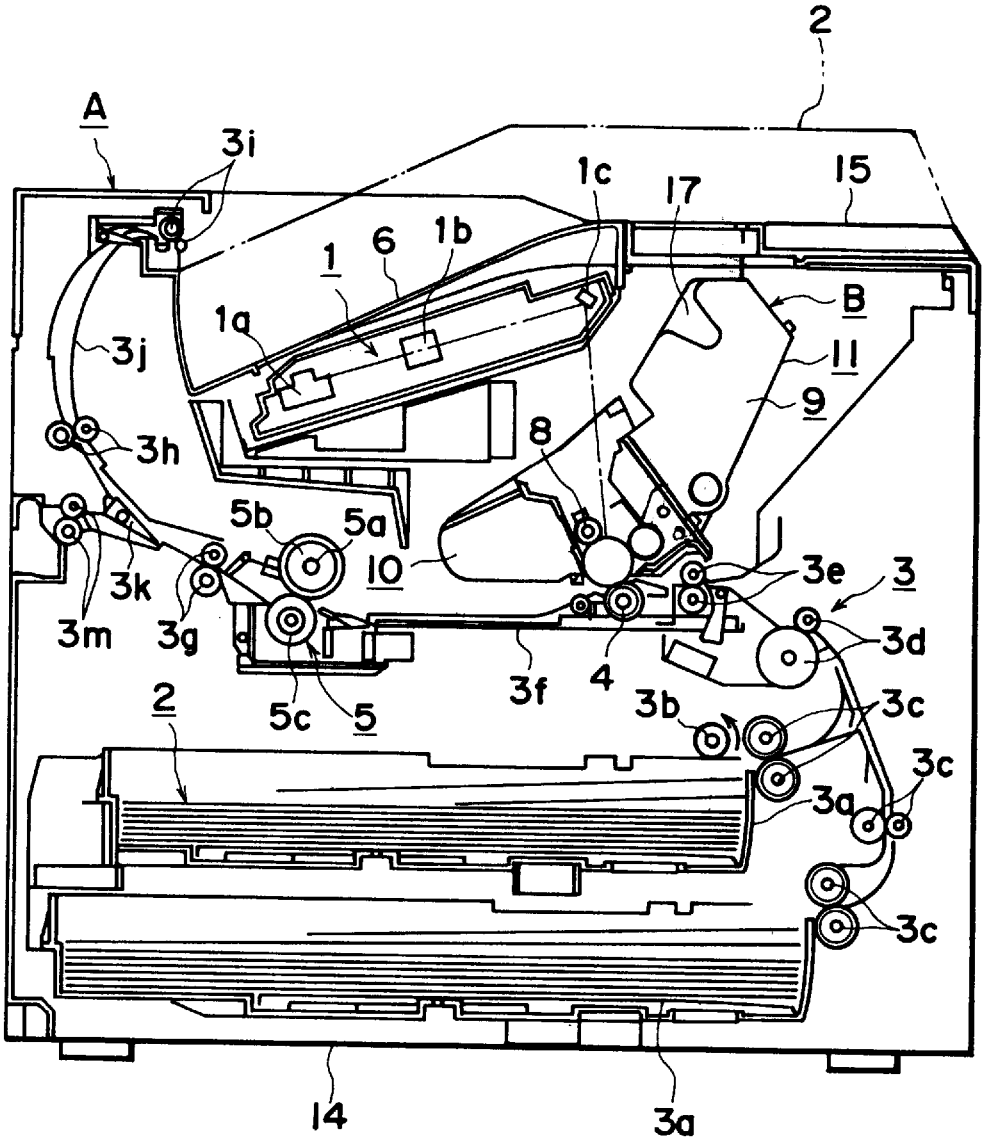
FIG. 5 is a schematic illustration of a laser beam printer.
Figure 6:
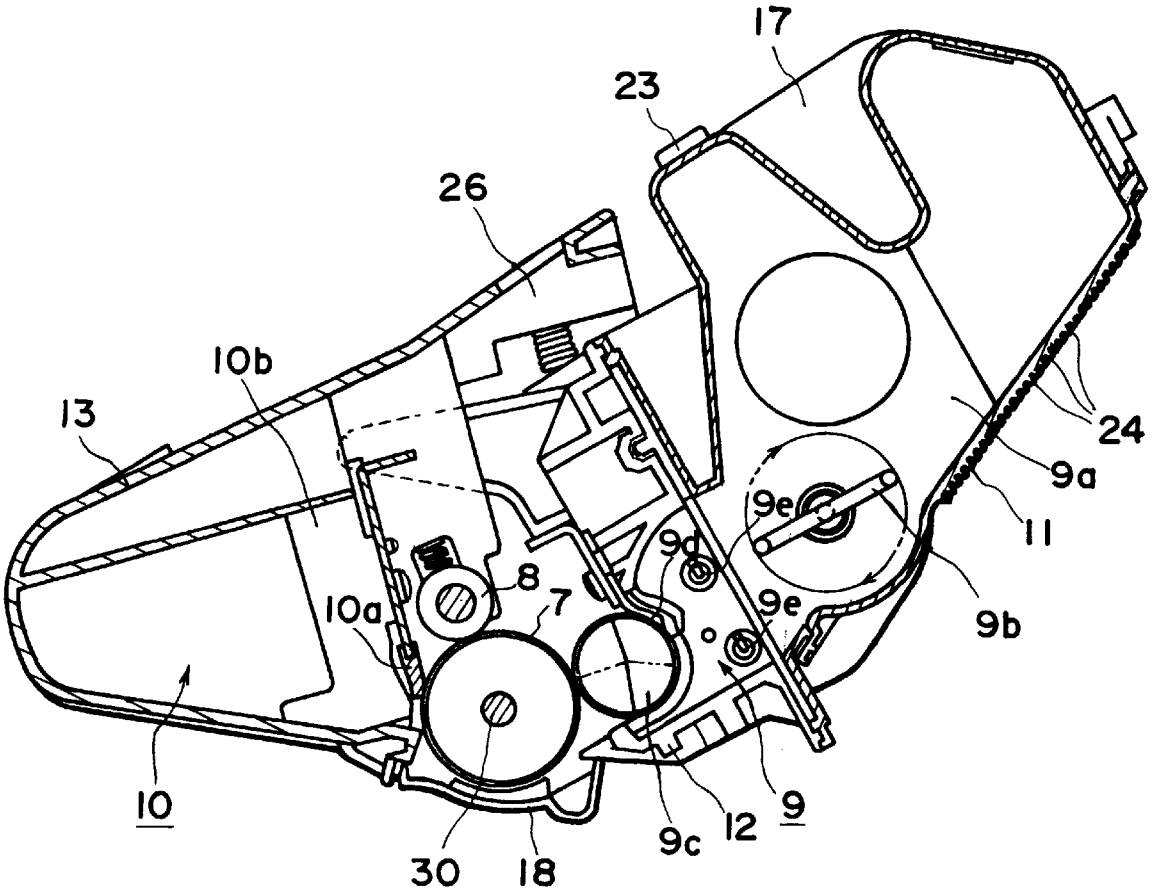
FIG. 6 is a schematic view of a process cartridge.
Figure 7:
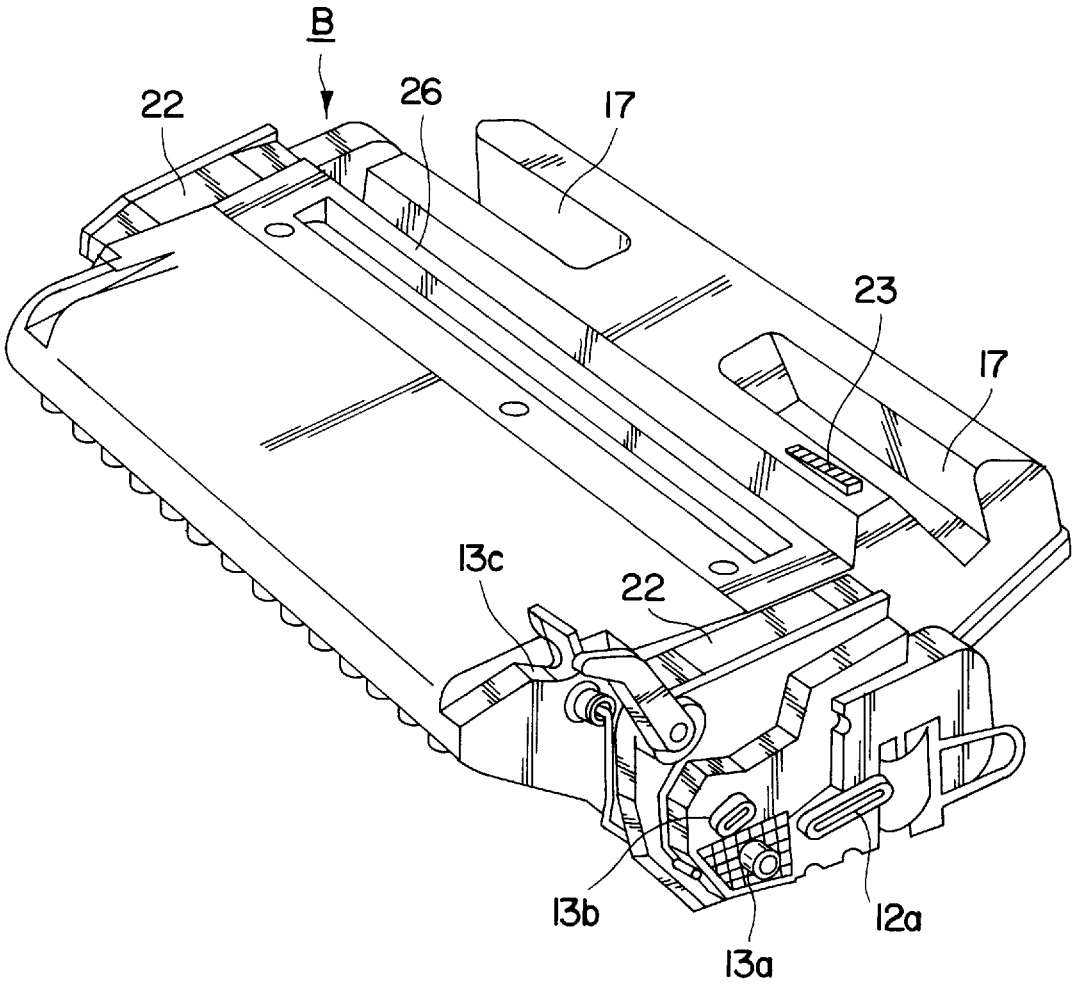
FIG. 7 is a perspective view of an outer appearance of a process cartridge.
Figure 8:
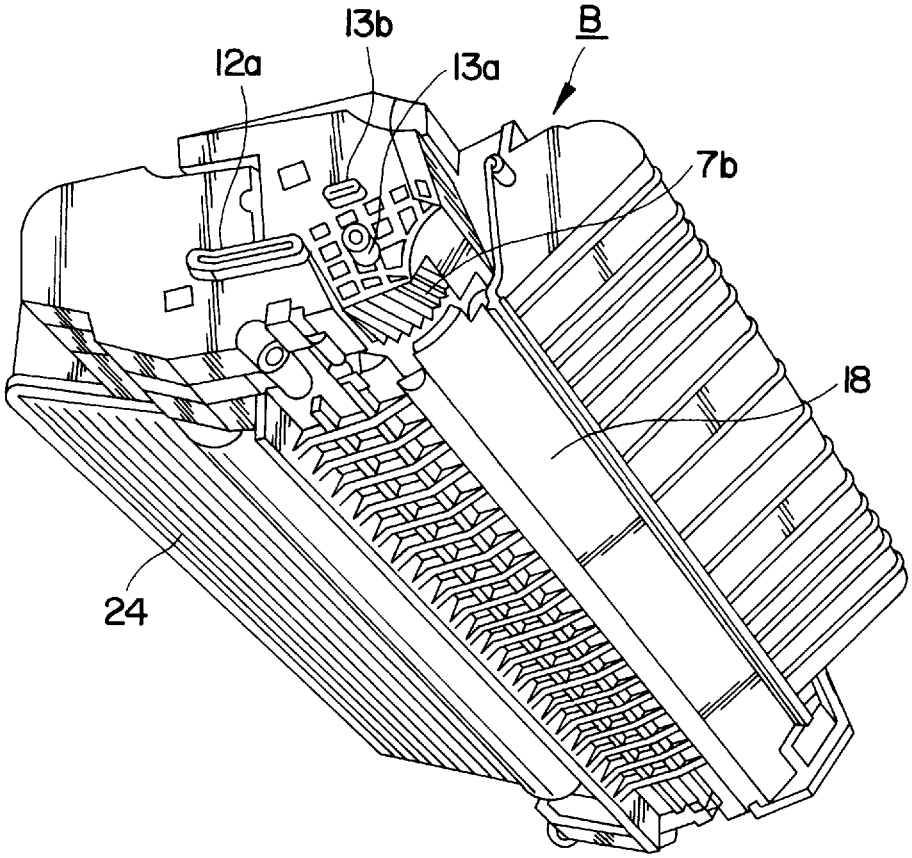
FIG. 8 is a perspective view of an outer appearance of a process cartridge.
Figure 9:
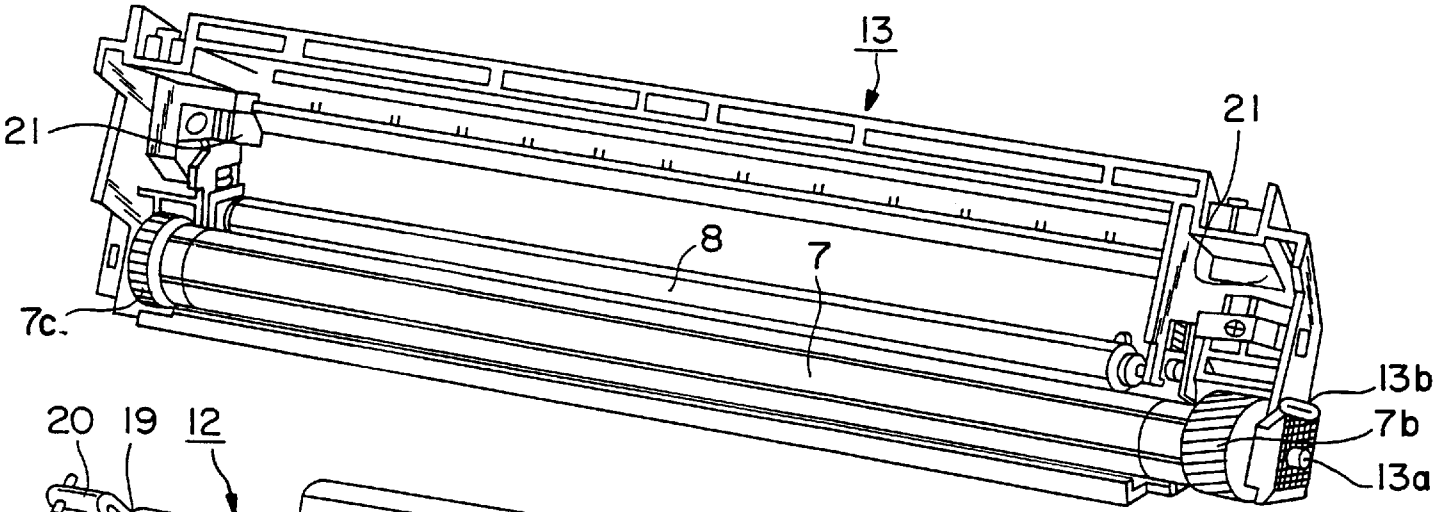
FIG. 9 is a perspective view of a cleaning unit.
Figure 10:
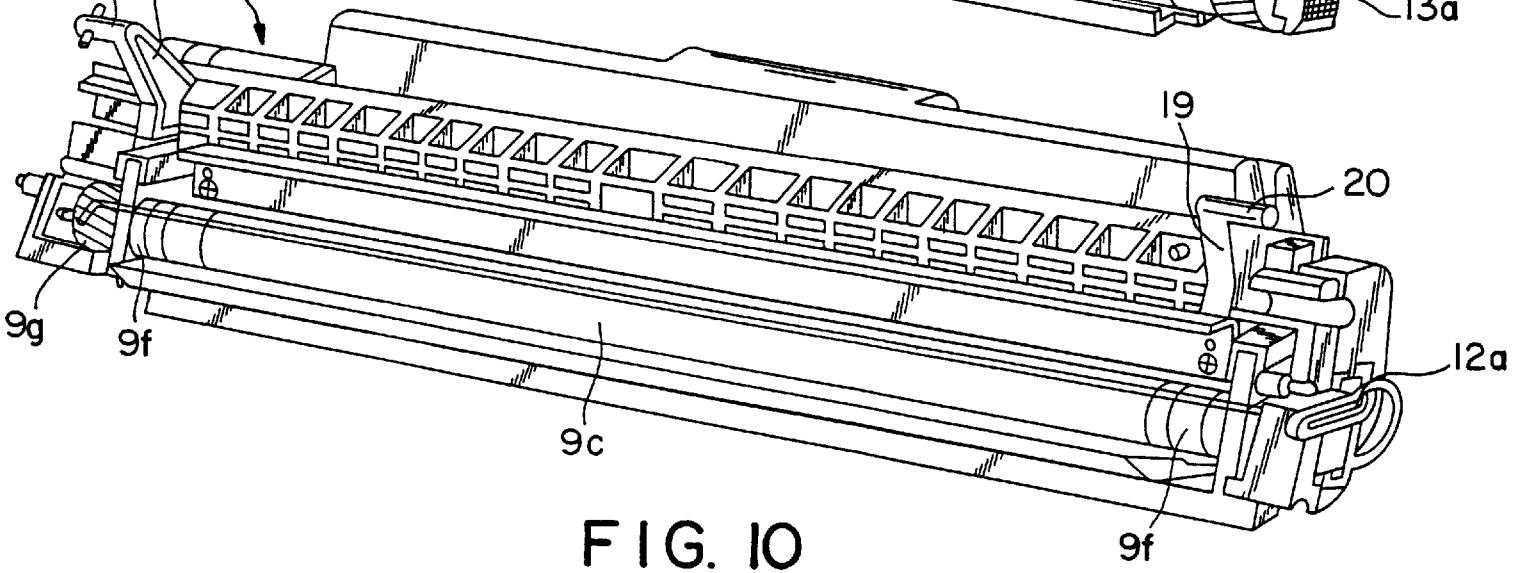
FIG. 10 is a perspective view of a cleaning unit.
Figure 11:
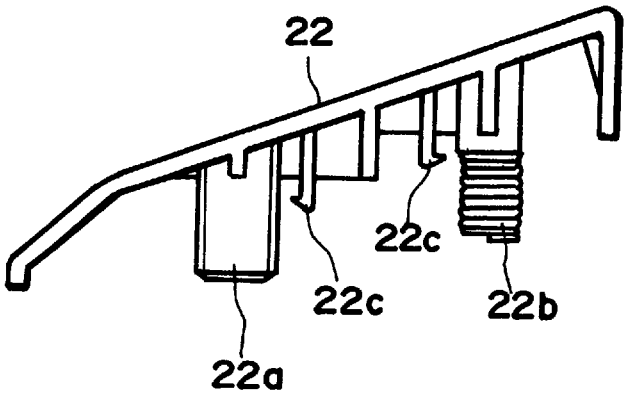
FIG. 11 shows a coupling member for combining a cleaning unit and a developing unit.
Figure 12:
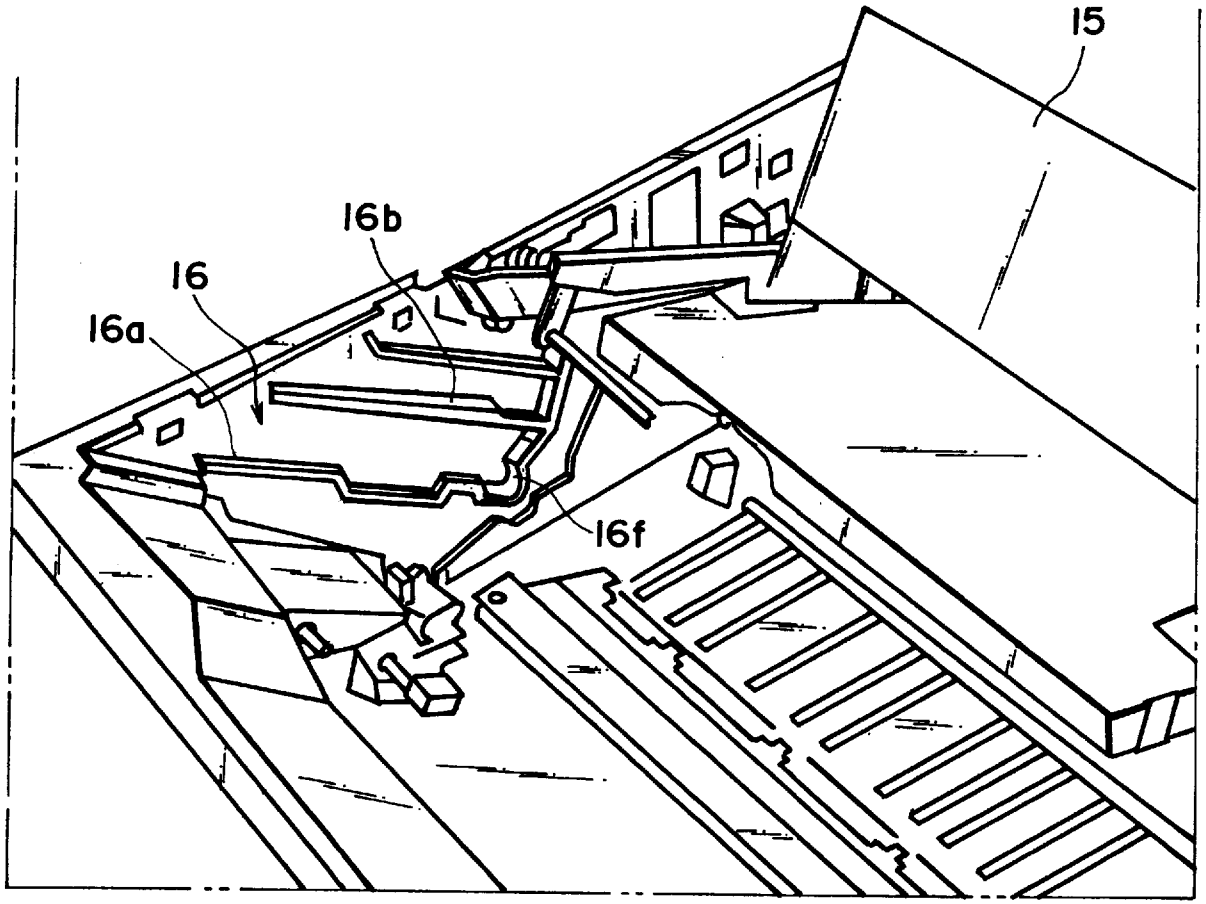
FIG. 12 is an illustration of mounting of a process cartridge.
Figure 13:
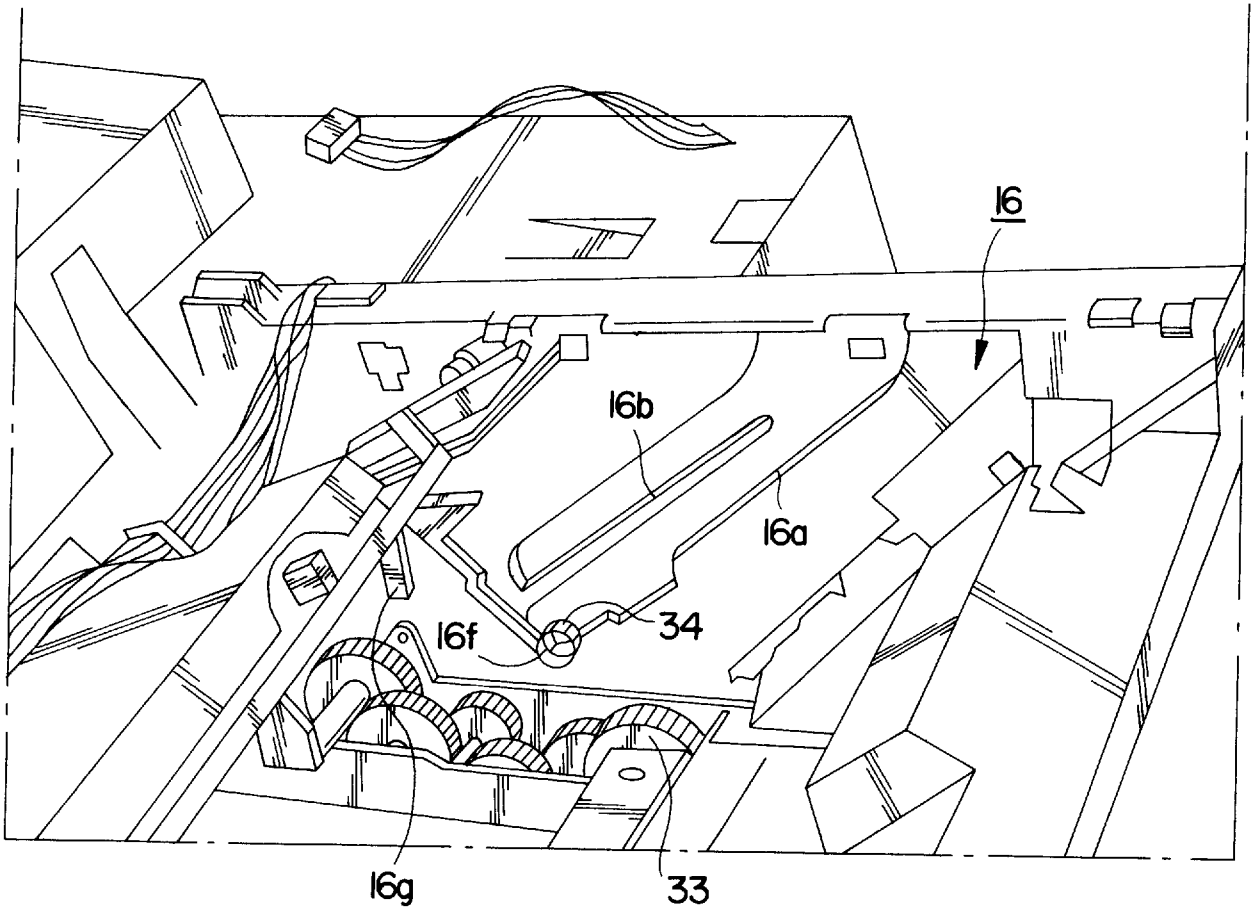
FIG. 13 is an illustration of mounting of a process cartridge.

Referring to FIG. 5 to FIG. 13, the description will be made as to a process cartridge and laser beam printer according to a first embodiment of the present invention. FIG. 5 is a schematic illustration of a laser beam printer; FIG. 6 is a schematic illustration of the process cartridge; FIGS. 7 and 8 are perspective views of an outer appearance of the process cartridge; FIGS. 9 and 10 are perspective views of an outer appearance of a cleaning unit and a developing unit; FIG. 11 shows a combination member for combining the cleaning unit and the developing unit; and FIGS. 12 and 13 are mounting structure illustrations of a process cartridge.

Here, the description will be made as to general structures of the laser beam printer and the process cartridge and then as to the photosensitive drum and the means therearound.

According to an embodiment of the present invention, there is provided a process cartridge detachably mountable to a main assembly of an electrophotographic image forming apparatus. The power cartridge includes a cartridge frame; an electrophotographic photosensitive drum having a cylinder and a photosensitive layer thereon; process means for acting on the photosensitive drum; a drum shaft for rotatably supporting the photosensitive drum on the cartridge frame, the drum shaft extending through the photosensitive drum and having a length sufficient to be supported by the cartridge frame at one end thereof and at the other end thereof wherein the drum shaft is provided on its outer peripheral adjacent its one end with projections and recesses, and is engaged with a hole in the cartridge frame; and a preventing member for preventing the drum shaft from disengaging from the cartridge frame.

{General Structure}

Figure 1:
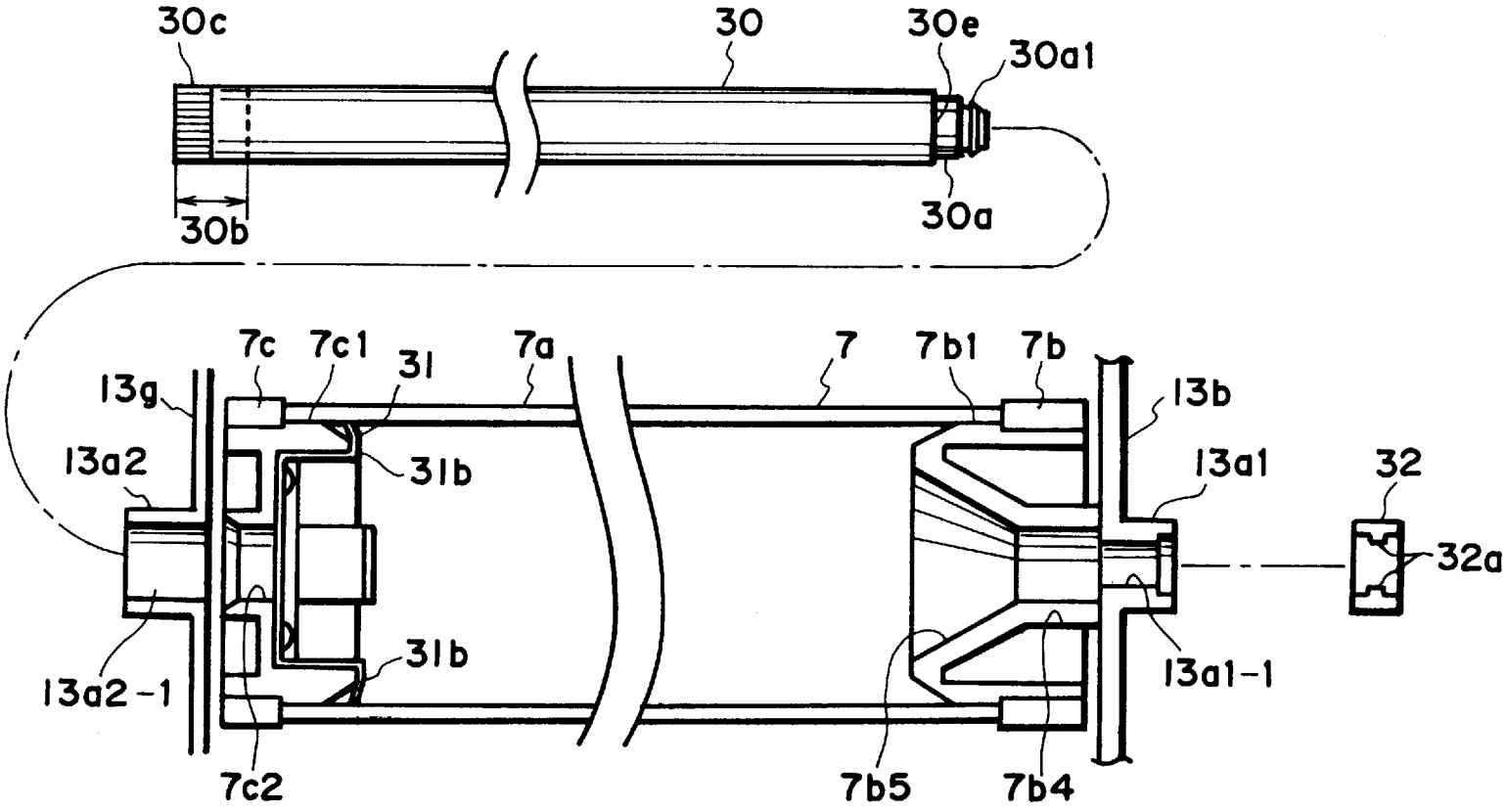
FIG. 1 is a sectional view of a drum according to an embodiment of the present invention.
Figure 2:
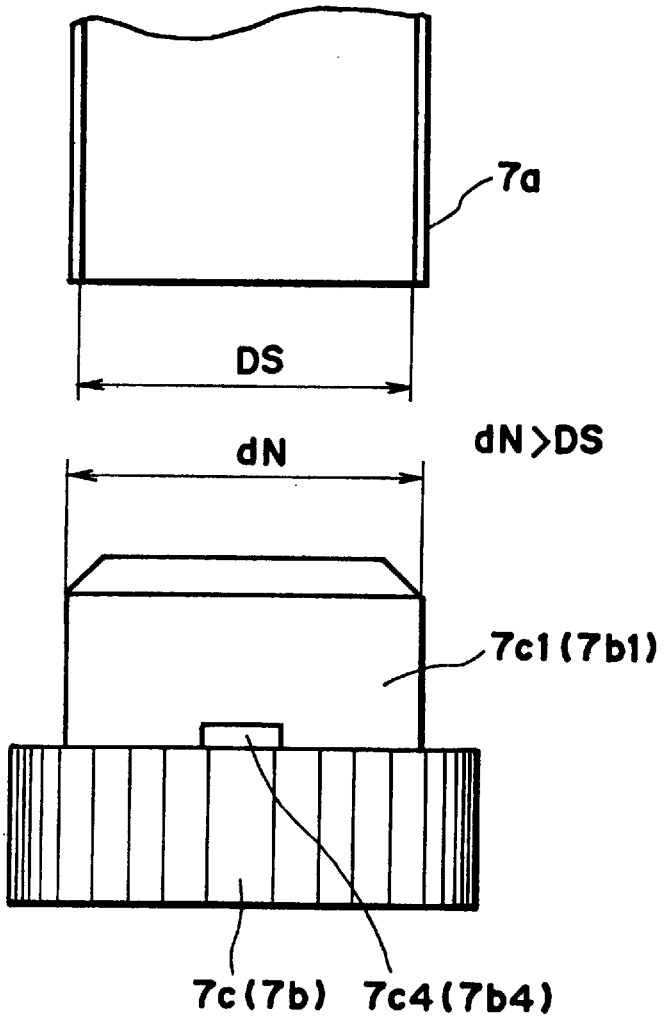
FIG. 2 illustrates a fit between a gear and a cylinder.

In the laser beam printer A, the beam from a laser beam source generated in accordance with image information, as shown in FIGS. 1 and 2, is deflected by a rotating polygonal mirror 1*a*, and is projected onto the electrophotographic photosensitive drum 7 through a lens 1*b* and reflection mirrors 1*c* (optical means 1) so that a latent image is formed thereon. The latent image is developed by developing means 9 into a toner image.

In synchronism with the formation of the toner image, a recording medium 2 is fed from a cassette 3*a* through a pick-up roller 3*b*, feeding. rollers 3*c* and 3*d*, and registration rollers 3*e* (feeding means 3). The toner image thus formed on the photosensitive drum 7 in an image formation portion in the form of a cartridge is transferred onto a recording medium 2 by voltage application to the transfer roller 4 as transferring means.

The recording medium 2 after the toner image transfer is transported along a guide member 3*f* into fixing means 5 comprising a fixing roller 5*b* having therein a heater 5*a* and a driving roller 5*c* press-contacted to the roller 5*b* for urging the recording material to the fixing roller 5*b*, where the transferred toner image is fixed on the recording medium 2. The recording medium 2 is then transported by discharging rollers 3*g*, 3*h* and 3*i* and is discharged to a discharging portion 6 through a reversion feeding path 3*j*. A swingable flapper 3*k* may be operated to directly discharge it not through the reversion feeding path 3*j* but by the discharging rollers 3*m*.

On the other hand, as shown in FIG. 6, a process cartridge B constituting the image formation portion is such that a photosensitive drum 7 having a photosensitive layer is rotated, and the surface thereof is charged uniformly by the voltage application to the charging roller 8 as charging means, and the light image from the optical means 1 is projected onto the photosensitive drum 7 through an exposure opening 26 to form the latent image, which is developed by developing means 9.

In the developing means 9, toner is fed out of a toner accommodating portion 9*a* by a toner feeding member 9*b*. A developing roller 9*c* containing therein a fixed magnet is rotated and a toner layer having triboelectric charge provided by a stirring member 9*c* and a development blade 9*d* is formed on the surface of the developing roller 9*c*. The toner is transferred onto the photosensitive drum 7 in accordance with the latent image to visualize it into a toner image.

The transfer roller 4 is supplied with a voltage of the opposite polarity from the toner image to transfer the toner image onto the recording medium 2. After the transfer, the toner remaining on the photosensitive drum 7 is removed by a cleaning blade 10*a* (cleaning means 10) and is collected into a residual toner container 10*b*.

The various parts such as the photosensitive drum 7 are accommodated in a housing constituted by combining the toner container 11 and the development frame 12 and further combining with a cleaning frame 13 into a form of a cartridge B. The process cartridge B is detachably mountable relative to a cartridge mounting means of the main assembly of the apparatus 14 in the form of a laser beam printer.

When the opening and closing member 15 is opened by rotating it about a pin 15*a* in the counterclockwise direction, as shown FIGS. 12 and 13, there is a cartridge mounting space, and a cartridge mounting guide member 16 is mounted to each of left and right inside surfaces of the main assembly of the apparatus 14. Each of the left and right guide members 16 comprises two guide portions 16*a* and 16*b* for guiding the dowels 13*a*, longitudinal guides 12*a* and short side guide 13*b* of the process cartridge B, as shown in FIGS. 7 and 9. The process cartridge B is inserted along the guides 16*a* and 16*b*, until the dowel 13*a* is engaged with the positioning portion 16*f*, and the rotation receiving portion-13*c* is supported by the rotation stopper portion 16*g* which is disposed below optical means 1 of the main assembly. Then, the opening and closing member 15 is closed, so that the positioning and mounting of the process cartridge B to the image forming apparatus A is completed.

By the positioning and the mounting, the drum gear (helical gear) 7*b* mounted to one end portion of the photosensitive drum 7 by press-fitting or crimping, is meshed with a driving gear 33 of the main assembly of the apparatus (FIG. 13), and a transmission gear (spur gear) 7*c* mounted to the other end thereof is meshed with an unshown gear fixed to the shaft of the transfer roller 4. With the drum gear 7*b* of the photosensitive drum 7, a sleeve gear 9*g* of the developing roller 9*c* (helical gear) is meshed.

Therefore, the rotation force of the driving gear 33 from the main assembly of the apparatus side is transmitted to the drum gear 7*b*, so that the photosensitive drum 7 is rotated, and the driving force is transmitted to the sleeve gear 9*g* through the drum gear 7*b* to rotate the developing roller 9*c*. Furthermore, the driving force is transmitted through the transmission gear 7*c* of the photosensitive drum 7 to rotate the transfer roller 4. For the purpose of facilitating the user's handling of the process cartridge B upon the mounting-and-demounting, it is provided with a grip 17 and ribs 23 and 24, as shown in FIGS. 6 and 8. The process cartridge B is further provided with a drum shutter 18 (FIG. 6) which opens and closes in interrelation with the mounting-and-demounting relative to the image forming apparatus A. When it is demounted from the image forming apparatus A, the shutter 18 is closed to protect the photosensitive drum 7.

{Housing Structure}

The process cartridge B of this embodiment comprises the housing constituted by combining the toner container 11, the development frame 12 and the cleaning frame 13. The structure of the housing will be described in detail.

As shown in FIG. 12, a toner accommodating portion 9*a* is formed and a toner feeding member 9*b* is mounted, in the toner container 11. The development frame 12 is provided with the developing roller 9*c* and the development blade 9*d*, and further with a rotatable stirring member 9*e* for circulating the toner in the developer chamber, adjacent the developing roller 9*c*. The toner container 11 and the development frame 12 are welded to each other to constitute an integral developing unit (FIG. 12).

To the cleaning frame 13, the photosensitive drum 7, charging roller 8 and the cleaning means 10 are mounted, and furthermore, the drum shutter member 18 for protecting the photosensitive drum 7 when the process cartridge B is dismounted from the main assembly 14, is mounted to constitute a cleaning unit (FIG. 13). The setting of the photosensitive drum 7 into the cleaning frame 13, will be described in detail in relation with the structure of the photosensitive drum 7.

By combining the developing unit and the cleaning unit with a coupling member, the process cartridge B is constituted. More particularly, as shown in FIG. 10, a rotational shaft 20 is mounted to the end portion of the arm portion 19 formed at each longitudinal end of the development frame 12 (FIG. 10), and on the other hand, at the longitudinal ends of the cleaning frame 13, there are formed recesses 21 for positioning and locking the rotational shaft 20, respectively (FIG. 13). The rotational shaft 20 is inserted into the recess 21, and the coupling member 22 having an integral projection 22*a*, a compression spring 22*b* and a locking claw 22*c* shown in FIG. 11 is coupled to the cleaning frame 13 by snap fitting, by which the developing unit and the cleaning unit are combined for rotation about the rotational shaft 20 relative to each other, and the developing roller 9*c* is urged to the photosensitive drum 7 by the weight of the developing unit. At this time, the development frame 12 is urged downwardly by the compression spring 22*b* mounted to the coupling member 22, by which the developing roller 9*c* is assuredly press-contacted to the photosensitive drum 7. Therefore, by mounting the spacer ring 9*f* (having a slightly larger diameter than the developing roller 9*c*) to the opposite longitudinal ends of the developing roller 9*c*, the ring 9*f* is press-contacted to the photosensitive drum 7, so that the photosensitive drum 7 and the developing roller 9*c* are opposed to each other with a predetermined clearance (approx. 300 μm approx.) therebetween.

The clearance between the photosensitive drum 7 and the developing roller 9*c* is required to be accurate since it is closely related with the density of the image, and in this embodiment, the clearance is designed as being approx. 300 μm±30 μm. Since the clearance is controlled only by the spacer rings 9*f* mounted to the end portions of the developing roller 9*c*, the circularity tolerance of the photosensitive drum 7 is designed as being not more than approx. 15 μm to avoid the density difference, and the gap difference between the opposite end portions is not more than approx. 15 μm.

{Structures of the Photosensitive Drum and Parts Therearound}

(Photosensitive Drum)

The photosensitive drum 7 comprises, as shown in FIG. 1, a cylinder 7*a* of drum configuration and having a photosensitive layer on the outer peripheral surface thereof; a gear 7*b* meshable with a gear 33 of the main assembly (FIG. 13). to receive the driving force; a gear 7*c* meshable with a gear 4*a* integrally rotatable with the transfer roller 4 to transmit the driving force thereto; and a grounding plate 31, fixed on the gear 7*c*, for electrical connection between the inside surface of the cylinder 7*a* and a penetrating shaft 30 which will be described hereinafter. The photosensitive drum 7 is rotatably supported on the cleaning frame 13 by the penetrating shaft 30, as shown in FIG. 1.

(Press-Fitting of the Gear)

The gears 7*b* and 7*c* have engaging portions 7*b*1 and 7*c*1 to be press-fitted into an end of the cylinder 7*a*. As shown in FIG. 2, the outer diameters dN of the engaging portions 7*b*1 and 7*c*1 are larger than the inner diameter DS of the cylinder 7*a* (dN>DS). In this embodiment, the outer diameters dN of the engaging portions 7*b*1 and 7*c*1 of the gears 7*b* and 7*c*, are larger than the inner diameter DS of the cylinder 7*a* by approx. 5–30 μm. Parts of end portions of the cylinder 7*a* are cut and bent and are engaged, after the press-fitting, with recesses 7*b*2 and 7*c*4 formed at the base portions of the engaging portions 7*b*1 and 7*c*1 of the gears 7*b* and 7*c*. Thus, the gears 7*b* and 7*c* are press-fitted into the opposite end portions of the cylinder 7*a*, and thereafter, parts of the end portion of the cylinder 7*a* are crimped to be engaged with the recesses 7*b*2 and 7*c*4 of the gears 7*b* and 7*c* by which the cylinder 7*a* and the gears 7*b* and 7*c* are securedly fixed to provide a photosensitive drum assembly as shown in FIG. 1. In FIG. 1, designated by 31 is a grounding plate which will be described hereinafter, and is fixed to one of the gears (gear 7*c*).

As described above, the engaging portions 7*b*1 and 7*c*1 of the gears 7*b* 7*c* are press-fitted into the end portions of the cylinder 7*a*, and therefore, the engaging portion of the gears receives the stress at the cylinder end portions during the crimping operation, so that the deformation of the cylinder is minimized. Therefore, as compared with a case of loose fitting of the gear into the cylinder end portion (outer diameter of gear engaging portion is smaller than inner diameter of cylinder), the circularity of the photosensitive drum 7 (particularly the circularity at the contact position relative to the spacer ring 9*f*) which is coaxial with the developing roller is improved, so that the clearance between the drum 7 and the developing roller 9*c* is maintained constant to provide good images.

(Grounding Plate)

Figure 4:
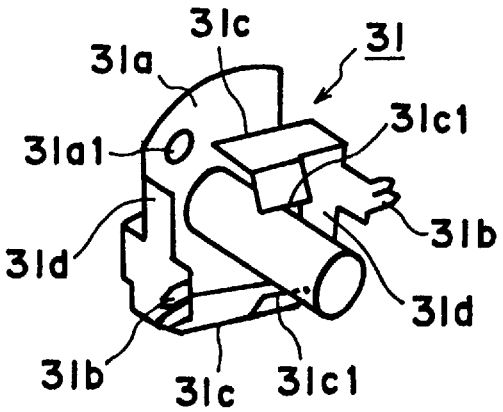
FIG. 4 is a perspective view of an outer appearance of a grounding plate.

The transmission gear 7*c* has the grounding plate 31, fixed thereon, for electrical conduction by contacting with the inside surface of the cylinder 7*a* and with the outside surface of the penetrating shaft 30. FIG. 4 is a perspective view of an outer appearance of the grounding plate 31. The grounding plate 31 is of a metal material, which is phosphor bronze in this embodiment. The grounding plate 31 has a base portion 31*a* with a positioning hole 31*a*1 which is engaged with an unshown dowel provided in a cylinder constituting the gear engaging portion 7*c*1. The dowel is heat-crimped to secure the grounding plate. By press-fitting the gear 7*c* fixed to the grounding plate 31 into the end portion of the cylinder 7*a*, the contact portion 31*b* of the grounding late 31 is contacted to the inside peripheral surface of the cylinder 7*a*.

The grounding plate 31 has a plurality of first arm portions 31*c* (two in this embodiment) urged and contacted to the outer periphery of the penetrating shaft 30 for rotatably supporting the photosensitive drum 7. The end portions of the two first arm portions 31*c* are bent in such an inclined direction as the approach to the direction of insertion of the penetrating shaft 30 which will be described hereinafter, and the edge portions 31*c*1 are press-contacted to the outer periphery of the penetrating shaft 30. By this, the first arm portion 31*c* deforms radially outwardly in accordance with the inserting operation of the penetrating shaft 30 which will be described hereinafter. The first arm portion 31*c* escapes along the outer peripheral surface of the penetrating shaft 30, and therefore, the insertion of the penetrating shaft 30 is smooth even if the penetrating shaft 30 has a groove or a step, and there is no liability of deformation of the grounding plate 31. Therefore, the assembling operativity is improved.

As shown in FIG. 4, the two first arm portions 31*c* of the grounding plate 31 are deviated so as to prevent overlapping of the edge portions 31*c*1 at the leading edges thereof (contact portion relative to the leading edge) in the direction of the axis of the penetrating shaft 30. Thus, the contact regions of the first arm portion 31*c* relative to the penetrating shaft 30 are not overlapped, and the contact state of the two arm portions 31*c* are independent from each other, and therefore, the stabilized electrical conduction is maintained even during the rotation of the photosensitive drum 7, for example. As described hereinbefore, the two arm portions 31*c* have end edge portions 31*c*1 abutted to the outer periphery of the penetrating shaft 30, and therefore, the degree of deviation in the direction of the axis may be small, and the contact pressures of the two arm portions 31*c* can be easily made equal.

The first arm portion 31*c* of the grounding plate 31 is disposed between the contact portion 31*b* and a positioning hole 31*a*1 at which the grounding plate 31 is fixed to the gear 7*c*. By positioning the first arm portion 31*c* between the fixed portions, the contact pressure of the first arm portion 31*c* relative to the penetrating shaft 30 is stabilized, thus providing stabilized electrical conduction. Additionally, the material can be saved, and therefore, the arrangement is economical.

(Penetrating Shaft)

The penetrating shaft 30, rotatably supports the photosensitive drum 7 of the above-described structure on the cleaning frame 13, and it has sufficient length to penetrate from one side wall 13*g* to the other side wall 13*h* of the photosensitive drum 7. The penetrating shaft 30 has an engaging portion 30*a* at one end portion having a reduced diameter, and is provided with a groove 30*a*1 for mounting a restraining member at the engaging portion edge (FIG. 1). At predetermined positions of the side walls of the cleaning frame 13, there are dowels 13*a*1 and dowel 13*a*2 for engaging and supporting the opposite ends of the penetrating shaft 30. Therefore, one end of penetrating shaft 30 (engaging portion 30*a*) is press-fitted into an engaging hole 13*a*1-1 of the dowel 13*a*1, and an inserting portion 30*b* at the other end thereof is loosely fitted in the engaging hole 13*a*2-1 of the dowel 13*a*2 to rotatably support the photosensitive drum 7, and is fixed on the cleaning frame 13.

The shaft end side of the inserting portion 30*b* is provided with knurled portion 30*c*, which preferably has longitudinal strips. Since the base part to be knurled has the same diameter the cylindrical portion of the support shaft (unknurled portion of the inserting portion 30*b*), the knurled portion 30*c* has a slightly larger diameter. Therefore, the fitting gap or difference is tighter between the knurled portion 30*c* and the hole 13*a*2-1. If desired, interference is used. The knurled portion may have a criss-cross pattern.

The dowels 13*a*1 and 13*a*2 are projected outwardly beyond the cleaning frame side wall to permit enough engaging length (approx. 4–10 mm in this embodiment). When the cartridge is to be mounted to the main assembly, the projected portions of the dowels 13*a*1 and 13*a*2, are guided by the guide portions 16*a* and 16*b* of the main assembly shown in FIGS. 8 and 9, and are brought into engagement with the positioning portion 16*f* finally, so that the process cartridge B is mounted in the main assembly at the correct position.

In this embodiment, the penetrating shaft 30 is of a metal material such as iron (excavated and abraded round bar), and the cleaning frame 13 is made of plastic resin material such as styrene resin material (acrylonitrile butadiene styrene (ABS), polystyrene resin (PS) or the like) or modified polyphenylene oxide (PPO). The engaging portion 30*a* of the penetrating shaft 30 is press-fitted into the dowel 13*a*1 of the cleaning frame 13 with the press-fitting difference of approx. 10–50 $\mu$m, and simultaneously, the inserting portion 30*b* having the knurled portion at the other end is loosely fitted in the dowel 13*a*2. By this, rotation of the penetrating shaft 30 due to the sliding friction relative to the gears 7*b* and 7*c* at the opposite ends of the drum, is prevented.

However, the cleaning frame 13 of the plastic resin material and the penetrating shaft 30 of the metal material have significantly different expansion coefficients relative to temperature change, and therefore, it is difficult to rely on the press-fitting alone for the fixing of the penetrating shaft 30. More particularly, when the temperature is higher than when the process cartridge is assembled, the engagement therebetween becomes loose with the result of liability of disengagement of the penetrating shaft 30 in the thrust direction thereof. If the press-fitting difference is increased at the engaging portion 30*a* of the penetrating shaft 30, the engagement may become so tight at low temperature with the result of liability of crack in the dowel 13*a*1 of the cleaning frame 13. To avoid these problems, the usable range of the press-fitting difference is zero or very narrow, and therefore, manufacturing is not easy.

Therefore, in this embodiment, a groove 30*a*1 is formed adjacent an end of the engaging portion of the penetrating shaft 30, as shown in FIG. 1, and a restraining member 32 in the form of a ring as shown in FIG. 1 is mounted to the groove 30*a*1. The restraining member 32 is of plastic resin material such as polyacetal (POM) or polypropylene (PP) and has such an inner diameter relative to the outer diameter of the engaging portion 30*a* so that they can be loosely fitted. The restraining member 32 has two projections 32*a* on the inner surface, and the projections 32*a* are projected to approx. 0.2 mm approx. inside beyond the inner diameter of the restraining member 32, and have a length of approx. ¼ of the inner circumference. When the use is made with the ring configuration restraining member 32, the restraining force in the thrust direction is smaller than a widely used E-type or C-type restraining member. However, the thrust force in the actual use is provided only by the spring force of the grounding electrode of the main assembly press-contacted to the end portion of the penetrating shaft 30 upon the cartridge mounting (approx. 80 gf–300 gf in this embodiment), and therefore, the restraining member 32 is usable.

The penetrating shaft 30 has a step 30*e* such that the diameter of the engaging portion 30*a* press-fitted at one side wall 13*h* side of the cleaning frame 13 is smaller than the diameter of the other portion and that the step 30*e* is abutted to the inner wall of the frame side wall upon the penetrating shaft insertion. By this structure, the insertion operation of the penetrating shaft is made easier, and the assembling operativity of the cartridge is improved.

Since the rear, in the shaft 30 inserting direction, end of the supporting shaft, is provided with the knurled portion, the supporting shaft 30 does not rotate by the friction torque provided by the rotation of the drum, even if the shaft is not press-fitted. Additionally, the provision of the knurled portion 30*c* permit reuse for recycling, even if the fitting gap is slightly increased.

The penetrating shaft 30 in this embodiment uses an excavated and abraded round bar, and is machined only at the engaging portion 30*a* and groove 30*a*1 having smaller diameter, and therefore, the cost is low. By using the penetrating shaft 30 as a support shaft for supporting the photosensitive drum 7 on the cleaning frame 13, the rigidity of the shaft support is enhanced so that the vibration of the photosensitive drum 7, and therefore, the pitch non-uniformity can be avoided.

(Mounting Process of the Photosensitive Drum)

Before the mounting of the photosensitive drum 7, the cleaning means 10, charging means 8 and seal or the like are mounted to the cleaning frame 13. As shown in FIG. 1, the photosensitive drum 7 is placed between both sides walls 13*g* and 13*h* of the cleaning frame 13, and as shown in FIG. 1, the penetrating shaft 30 is inserted from the side wall 13*g* side until the step 30*e* of the penetrating shaft 30 abuts the inner wall of the side wall 13*h*.

The penetrating shaft 30 is first penetrated through the hole 13*a*2-1 of the dowel 13*a*2 of the side wall 13*g* and through the insertion hole 7*c*2 of the gear 7*c* toward the grounding plate 31. At this time, the grounding plate 31 fixed to the gear 7*c*, changes from the state shown in FIG. 16 to the state shown in FIG. 17. Since the end portion of the first arm portion 31*c* of the grounding plate 31 is bent inclinedly to the inserting direction, the arm portion 31*c* avoids deformation along the outer peripheral surface when the penetrating shaft 30 is inserted. Therefore, the insertion of the penetrating shaft 30 is smooth, and the deformation of the grounding plate 31 can be avoided. The edge portions 31*c*1 of the arm portion 31*c* are press-contacted at positions not overlapped in the axial direction of the penetrating shaft 30 so that the electrical connection is stabilized.

Then, the penetrating shaft 30 is penetrated through the insertion hole 7*b*4 of the gear 7*b*, and the engaging portion 30*a* is press-fitted into the hole 13*a*1-1 of the dowel 13*a*1 of the side wall 13*h*, and the shaft is further inserted until the step 30*e* is abutted to the inner wall of the side wall 13*h*, and simultaneously, the inserting portion 30*b* is engaged in the hole 13*a*2-1 of the dowel 13*a*2 of the side wall 13*g*. By this, the insertion is finished. The insertion portion of the hole 7*b*4 of the gear 7*b* is a significantly tapered hole 7*b*1 to permit oblique insertion of the penetrating shaft 30.

The restraining member 32 is engaged in the groove 30*a*1 of the penetrating shaft end portion using the dowel 13*a*1. By this, the disengagement of the penetrating shaft 30 in the thrust direction is prevented, and the mounting of the parts to the cleaning frame 13 is completed to provide the cleaning unit as shown in FIG. 9. The cleaning unit and the developing unit are coupled by the coupling member to provide the process cartridge B.

(Grounding of Photosensitive Drum)

When the process cartridge B is mounted to the main assembly 14, the dowels 13*a*1 and 13*a*2 on the side walls 13*g* and 13*h* of the cleaning frame 13 are finally engaged with the positioning portion 16*f* in the main assembly, so that the process cartridge B is positioned to the main assembly 14. At this time, the grounding electrode 34 of the main assembly is urged by contact with the end surface of the penetrating shaft 30, and is deformed. Since the gear 7*b* at the drum end portion is a helical gear, thrust force is produced toward the grounding electrode when it receives force from the gear 33 of the main assembly. By this, the grounding electrode 34 is urged further, and is deformed until it abuts the side wall of the main assembly. The grounding electrode 34 is connected to GND of an electrical substrate in the main assembly. Therefore, the charge on the photosensitive drum 7 charged by a charging roller 8 during the image formation flows through the photosensitive drum, grounding plate, penetration shaft, grounding electrode and the electric substrate, all of which are made of metal material. Therefore, the current flows stably without storing, upon projection of the laser beam to the photosensitive drum.

Embodiment 2

In Embodiment 1, the supporting shaft is a penetrating shaft. In Embodiment 2, it is in the form of separated shafts or pins.

Figure 3:
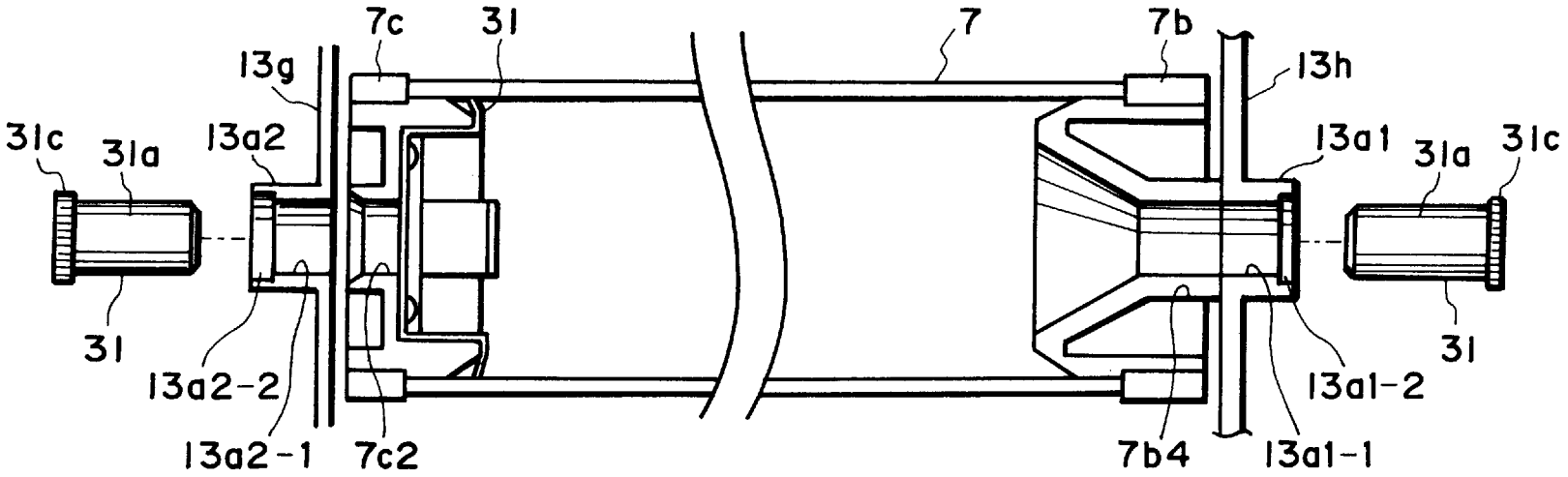
FIG. 3 is an exploded view in an embodiment wherein a drum shaft is inserted at each of the opposite ends of the drum.

As shown in FIG. 3, the shaft 31 has a cylindrical portion 31*a* and a stepped portion with a knurled portion having a larger diameter than that. The small diameter cylindrical portion 31*a* is engaged with the holes 7*b*4 and 7*c*2 of the gears 7*b* and 7*c* of the photosensitive drum, and are engaged with small diameter portions 13*a*1-1 and 13*a*2-1 of the side wall 13*g* and 13*h* of the cleaning frame 13. An outer surface of the large diameter portion 31*c* of the supporting shaft 30 is knurled (30*c*). The knurled pattern 30*c* is press-fitted into the large diameter holes 13*a*1-2 and 13*a*2-2 of the dowels 13*a*1 and 13*a*2. The lengths of the cylindrical portion 31*a* of the left and right shafts are different, and the shaft 30 engaged with the dowel 13*a*2 penetrates the grounding plate in the longitudinal direction.

The structure of this embodiment is the same as Embodiment 1. As shown in FIG. 3, the photosensitive drum 7 is positioned on the cleaning frame, and the supporting shafts 30 are brought into engagement with the dowels 13*a*1 and 13*b*2 and gears 7*b* and 7*c* from the opposite sides.

Other Embodiments

In the above-described embodiment, two first arm portions 31*c* of the grounding plate 31 are provided, but the number may be three, four or more. The material of the grounding plate 31 has been described as being phosphor bronze, but another material such as SUS (stainless steel) is usable.

In the above-described embodiment, the electrophotoaraphic photosensitive member has been a drum having an end portion engagement member press-fitted and crimped. This is not limited to the electrophotographic photosensitive member, but is usable with a cylindrical member with which crimping is usable (developing roller or the like) with similar advantages.

In the above-described embodiment, the outer diameter of the engaging portion 30*a* provided at one end of the penetrating shaft 30 is stepwisely smaller than the outer diameter of the other portion, but this feature is not inevitable, and the same diameter is usable. In this case, end portions of the penetrating shaft 30 are provided with grooves, respectively, and the restraining members 32 are inserted into the grooves using dowels 13*a*1 and 13*a*2 of the cleaning frame 13. Similarly to the above-described embodiment, the inner diameter of the engaging portion 30*a* of the penetrating shaft 30 is selected to provide press-fitting relative to the side wall 13*h* of the frame 13. According to this structure, the preparation of the restraining member and the insertion process thereof are added to the manufacturing step of the penetrating shaft 30, but the machining process for the outer diameter is eliminated, and therefore, the manufacturing cost is reduced.

Further, in each of the preceding embodiments, the process cartridge B is of a type which is used to form a monochrome image, but the present invention is also applicable to a multicolor process cartridge, which comprises two or more developing means and is used to form a multicolor image (image of two colors, three colors, or full-color).

As for the electrophotographic photosensitive member, it is not limited to the aforementioned photosensitive drum 7. The present invention is also applicable to the following. To begin with, the usable photoconductive material includes amorphous silicone, amorphous selenium, zinc oxide, titanium oxide, organic photoconductor (OPC), or the like. Further, as for the configuration of a base member on which the photosensitive material is placed, a base member in the form of a drum or a belt is used. For example, in the case of the base member of the drum type, the photoconductive material is coated deposited or placed by the like means on a cylinder of aluminum alloy or the like.

As for the developing method, the present invention is compatible with various well-known methods such as the double component magnetic brush developing method, cascade developing method, touch down developing method, cloud developing method, and the like.

Further, as to the structure of the charging means, the so-called contact charging method is employed in the first embodiment, but the present invention is also applicable to other conventional charging methods such as the one in which a metallic shield of aluminum or the like is placed on three sides of a tungsten wire, and positive or negative ions generated by applying a high voltage to the tungsten wire are transferred onto the surface of the photosensitive drum to charge it uniformly.

Further, the aforementioned charging means may be of the blade type (charging blade), pad type, block type, rod type, wire type, or the like, in addition to the roller type described above.

As for the method for cleaning the residual toner on the photosensitive drum, the cleaning means may be constituted of a blade, fur brush, magnetic brush or the like.

The process cartridge is provided at least with an electrophotographic photosensitive member or the like and at least one process means. The process cartridge may be a cartridge which is detachably mountable to a main assembly of an image forming apparatus and which contains as a unit an electrophotographic photosensitive member and charging means. The process cartridge may be a cartridge which is detachably mountable to a main assembly of an image forming apparatus and which contains as a unit an electrophotographic photosensitive member and developing means. The process cartridge may be a cartridge which is detachably mountable to a main assembly of an image forming apparatus and which contains as a unit an electrophotographic photosensitive member and cleaning means. The process cartridge may be a cartridge which is detachably mountable to a main assembly of an image forming apparatus and which contains as a unit an electrophotographic photosensitive member and two or more process means.

The process cartridge means a cartridge having as a unit an electrophotographic photosensitive member, and charging means, developing means and cleaning means, which is detachably mountable to a main assembly of an image forming apparatus. It may include as a unit an electrophotographic photosensitive member and at least one of charging means, developing means and cleaning means. It may include as a unit developing means and an electrophotographic photosensitive member.

In the foregoing, the description has been made as to a laser beam printer as an exemplary image forming apparatus, but the present invention is applicable to an electrophotographic copying machine, facsimile machine, word processor or another image forming machine As described in the foregoing, according to this embodiment, the rigidity of the shaft support for the electrophotographic photosensitive drum can be increased at low cost by using a penetrating shaft for the electrophotographic photosensitive drum. Therefore, even if the electrophotographic photosensitive drum receives the driving force from the main assembly, the shaft axis is not deviated, thus maintaining high image quality. Additionally, the vibration of the electrophotographic photosensitive drum during the driving is prevented, and therefore, an image free of pitch non-uniformity is produced.

Additionally, the support shaft has at least one end press-fitting portion relative to the cartridge frame, and a mounting portion for a shaft restraining member is provided at the end portion, and the restraining member is made of an elastic member in the form of a ring and has an engaging portion for engagement with the mounting portion of the support shaft, by which the assembling process is simplified without deterioration of the shaft restraining effect.

According to the invention, the supporting shaft is prevented from rotating with minimum cost increase even if the load on the photosensitive drum increases. Therefore, the noise at the contact portion can be avoided. Additionally, since the supporting shaft is stationary, a stabilized image can be provided.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an electrophotographic image forming apparatus, comprising:

a cartridge frame having a hole for engaging one end of a drum shaft;

an electrophotographic photosensitive drum having a cylinder and a photosensitive layer thereon;

process means actable on said photosensitive drum;

a drum shaft for rotatably supporting said photosensitive drum on said cartridge frame, said drum shaft extending through said photosensitive drum and having a length sufficient to be supported by said cartridge frame at one end thereof and at the other end thereof, wherein an area of said drum shaft on its outer peripheral surface adjacent the one end is engaged with a hole in said cartridge frame and has projections and recesses thereon to increase friction with the hole;

a preventing member for preventing said drum shaft from disengaging from said cartridge frame.

2. A cartridge according to claim 1, wherein the one end of said drum shaft is press-fitted in said cartridge frame, and the other end of said drum shaft is prevented from disengaging from said cartridge frame by said preventing member.

3. A cartridge according to claim 1 or 2, wherein said preventing member is in the form of a ring having an inside surface with an inward projection which is engaged with a groove formed on an outer periphery of said drum shaft, wherein said preventing member is formed of plastic resin material, and said drum shaft is formed of metal.

4. A cartridge according to claim 3, wherein a plastic resin material of said cartridge frame is acrylonitrile butadiene styrene (ABS) resin material, polystyrene resin (PS) resin material or polyphenylene oxide (PPO) resin material, and said preventing member is formed of polyacetal (POM) resin material or polypropylene (PP) resin material, and the metal is steel.

5. A cartridge according to claim 3, further comprising projections projecting outwardly from lateral walls of said cartridge frame, said projections having respective holes with which the one and the other ends of said drum shaft are engaged respectively.

6. A cartridge according to claim 5, wherein said projections are guided by guides on the main assembly when said process cartridge is mounted to said main assembly.

7. A cartridge according to claim 5, wherein said cartridge frame comprises a cleaning frame supporting the photosensitive drum and process means which includes a charging member and a cleaning member, and a developing frame supporting a developing member as process means and a toner container for containing toner to be used by the developing member, wherein said cleaning frame and said developing frame are rotatable relative to each other, and wherein said projections are provided on an outer wall of said cleaning frame.

8. A cartridge according to claim 1 or 2, further comprising projections projecting outwardly from lateral walls of said cartridge frame, said projections having respective holes with which the one and the other ends of said drum shaft are engaged respectively.

9. A cartridge according to claim 8, wherein said projections are guided by guides on the main assembly when said process cartridge is mounted to said main assembly.

10. A cartridge according to claim 8, wherein said cartridge frame comprises a cleaning frame supporting the photosensitive drum and process means which includes a charging member and the cleaning member, and a developing frame supporting a developing member as process means and a toner container for containing toner to be used by the developing member, wherein said cleaning frame and said developing frame are rotatable relative to each other, and wherein said projections are provided on an outer wall of said cleaning frame.

11. A cartridge according to claim 7, wherein said photosensitive drum is provided with a spur gear at one longitudinal end thereof and a helical gear at the other longitudinal end, wherein said preventing member is located nearer to said other longitudinal end than said one longitudinal end, and wherein when said process cartridge is mounted to the main assembly, said helical gear receives driving force from the main assembly to rotate said photosensitive drum, and transmits the driving force to the developing member in the form of a developing roller, and wherein when said process cartridge is mounted to the main assembly, said spur gear transmits driving force to a transfer roller provided in said main assembly.

12. A cartridge according to claim 8, wherein said photosensitive drum is provided with a spur gear at one longitudinal end thereof and a helical gear at the other longitudinal end, wherein said preventing member is located nearer to said other longitudinal end than said one longitudinal end, and wherein when said process cartridge is mounted to the main assembly, said helical gear receives driving force from the main assembly to rotate said photosensitive drum, and transmits the driving force to the developing member in the form of a developing roller, and wherein when said process cartridge is mounted to the main assembly, said spur gear transmits driving force to a transfer roller provided in said main assembly.

13. A cartridge according to claim 11, further comprising a grounding member in the cylinder of said photosensitive drum, said grounding member being contacted to an inner surface of said cylinder and an outer surface of said drum shaft, wherein said grounding member electrically grounds said photosensitive drum to the main assembly through said drum shaft, and wherein said grounding member is mounted to said spur gear.

14. A cartridge according to claim 12, further comprising a grounding member in the cylinder of said photosensitive drum, said grounding member being contacted to an inner surface of said cylinder and an outer surface of said drum shaft, wherein said grounding member electrically grounds said photosensitive drum to the main assembly through said drum shaft, and wherein said grounding member is mounted to said spur gear.

15. A cartridge according to claim 11, wherein said helical gear is provided with a through hole through which said drum shaft is penetrated, and said through hole is tapered such that a diameter thereof decreases, from a drum shaft entrance side to the opposite side.

16. A cartridge according to claim 12, wherein said helical gear is provided with a through hole through which said drum shaft is penetrated, and said through hole is tapered, such that a diameter thereof decreases, from a drum shaft entrance side to the opposite side.

17. A process cartridge detachably mountable to a main assembly of an electrophotographic image forming apparatus, comprising:

an electrophotographic photosensitive drum having a cylinder and a photosensitive layer thereon;

a charging device for charging said photosensitive drum;

a developing member for developing a latent image formed on said photosensitive drum;

a cleaning member for removing residual toner from said photosensitive drum;

a cleaning frame for supporting the photosensitive drum, charging device and the cleaning member;

a developing frame for supporting the developing member and a toner container for containing toner to be used by the developing member, wherein said cleaning frame and said developing frame are rotatable relative to each other;

a drum shaft for rotatably supporting said photosensitive drum on said cleaning frame, said drum shaft extending through said photosensitive drum and having a length sufficient to be supported by said cleaning frame at one end thereof and at the other end thereof, wherein projections and recesses are provided on a portion of said drum shaft on its outer peripheral surface adjacent the one end to increase friction when the one end is engaged with a hole provided in a frame of said cartridge;

a first projection projecting outwardly from a lateral wall of a first frame portion of said cleaning frame adjacent one longitudinal end of said photosensitive drum, said first projection having a hole with which the portion of said drum shaft having the projections and recesses is engaged;

a second projection projecting outwardly from a lateral wall of a second frame portion of said cleaning frame adjacent the other longitudinal end of said photosensitive drum, said second projection having a hole with which the other end of said drum shaft is engaged;

a preventing member for preventing said drum shaft from disengaging from said cleaning frame, wherein the one end of said drum shaft is press-fitted in said cartridge frame, and the other end thereof is prevented from disengaging from said cartridge frame by said preventing member;

wherein said photosensitive drum is provided with a spur gear at one longitudinal end thereof and a helical gear at the other longitudinal end, wherein said preventing member is located nearer to said other longitudinal end than said one longitudinal end, and wherein when said process cartridge is mounted to the main assembly, said helical gear receives driving force from the main assembly to rotate said photosensitive drum, and transmits the driving force to the developing member in the form of a developing roller, and wherein when said process cartridge is mounted to the main assembly, said spur gear transmits driving force to a transfer roller provided in said main assembly.

18. A cartridge according to claim 17, wherein said preventing member is in the form of a ring having an inside surface with an inward projection which is engaged with a groove formed on an outer periphery of said drum shaft, wherein said preventing member is formed of plastic resin material, and said drum shaft is of metal.

19. A cartridge according to claim 17, wherein a plastic resin material of said cartridge frame is acrylonitrile butadiene styrene (ABS) resin material, polystyrene resin (PS) resin material or polyphenylene oxide (PPO) resin material, and said preventing member is formed of polyacetal (POM) resin material or polypropylene (PP) resin material, and the metal is steel.

20. A cartridge according to claim 17 or 19, wherein said first and second projections on said first and second frame portions are guided by guides on the main assembly.

21. A cartridge according to claim 20, further comprising a grounding member in the cylinder of said photosensitive drum, said grounding member being contacted to an inner surface of said cylinder and an outer surface of said drum shaft, wherein said grounding member electrically grounds said photosensitive drum to the main assembly through said drum shaft, and wherein said grounding member is mounted to said spur gear.

22. A cartridge according to claim 21, wherein said helical gear is provided with a through hole through which said drum shaft is penetrated, and said through hole is tapered, such that a diameter thereof decreases, from a drum shaft entrance side to the opposite side.

23. A process cartridge detachably mountable to a main assembly of an electrophotographic image forming apparatus comprising:

an elertrophotographic photosensitive drum having a cylinder and a photosensitive layer thereon;

a charging roller for charging said photosensitive drum;

a developing roller for developing a latent image formed on said photosensitive drum;

a cleaning blade for removing residual toner from said photosensitive drum;

a cleaning frame for supporting the photosensitive drum, charging roller and the clearing blade, wherein said cleaning frame is formed of plastic resin material;

a developing frame for supporting the developing roller and a toner container for containing toner to be used by the developing roller, wherein said cleaning frame and said developing frame are rotatable relative to each other, wherein said developing frame is formed of plastic resin material;

a drum shaft for rotatably supporting said photosensitive drum on said cleaning frame, said drum shaft extending through said photosensitive drum and having a length sufficient to be supported by said cleaning frame at one end thereof and at the other end thereof, wherein said drum shaft is formed of metal, and wherein projections and recesses are provided on a portion of said drum shaft on its outer peripheral surface adjacent the one end to increase friction when the one end is engaged with a hole provided in the cleaning frame;

a first projection projecting outwardly from a lateral wall of a first frame portion of said cleaning frame adjacent one longitudinal end of said photosensitive drum, said first projection having a hole with which the portion of said drum shaft having the projections and recesses is engaged, wherein when said process cartridge is mounted to the main assembly, said first projection is guided by a guide on the main assembly;

a second projection projecting outwardly from a lateral wall of a second frame portion of said cleaning frame adjacent the other longitudinal end of said photosensitive drum, said second projection having a hole with which the other end of said drum shaft is engaged, wherein when said process cartridge is mounted to the main assembly, said second projection is guided by a guide on the main assembly;

a preventing member for preventing said drum shaft from disengaging from said cleaning frame, wherein said preventing member is in the form of a ring having an inside surface with an inward projection which is engaged with a groove formed in an outer periphery of said drum shaft, wherein said one end of said drum shaft is press-fitted in said cleaning frame, and the other end thereof is prevented from disengaging from said cleaning frame by said preventing member, wherein said preventing member is formed of plastic resin material;

wherein said photosensitive drum is provided with a spur gear at one longitudinal end thereof and a helical gear at the other longitudinal end, wherein said preventing member is located nearer to said other longitudinal end than said one longitudinal end, and wherein when said process cartridge is mounted to the main assembly, said helical gear receives driving force from the main assembly to rotate said photosensitive drum, and transmits the driving force to the developing roller, and wherein when said process cartridge is mounted to the main assembly, said spur gear transmits driving force to a transfer roller provided in said main assembly; and said cartridge further comprises:

a grounding member in the cylinder of said photosensitive drum, said grounding member being contacted to an inner surface of said cylinder and an outer surface of said drum shaft, wherein said grounding member electrically grounds said photosensitive drum to the main assembly through said shaft, and wherein said grounding member is mounted to said spur gear.

24. A cartridge according to claim 23, wherein said helical gear is provided with a through hole through which said drum shaft is penetrated, and said through hole is tapered, such that a diameter thereof decreases, from a drum shaft entrance side to the opposite side.

25. A cartridge according to claim 23 or 24, wherein a plastic resin material of said cleaning frame is acrylonitrile butadiene styrene (ABS) resin material, polystyrene resin (PS) resin material or polyphenylene oxide (PPO) resin material, and said preventing member is formed of polyacetal (POM) resin material or polypropylene (PP) resin material, and the metal is steel.

26. An assembling method for a process cartridge detachably mountable to a main assembly of an image forming apparatus, said process cartridge comprising an electrophotographic photosensitive drum and process means actable on said photosensitive drum, wherein said photosensitive drum has a cylinder and a photosensitive layer thereon, said method comprising:

(a) a disposing step of disposing the photosensitive drum between a first frame portion of the cartridge frame and a second frame portion of the cartridge frame;

(b) a drum shaft inserting step including inserting a drum shaft for rotatably supporting the photosensitive drum on said cartridge frame into a hole formed in the first frame portion of the cartridge frame from an outside of the first frame portion adjacent one longitudinal end portion of said photosensitive drum, penetrating the drum shaft through the photosensitive drum, and inserting the drum shaft penetrating the photosensitive drum into a hole formed in the second frame portion of the cartridge frame from an inside of the second frame portion adjacent the other longitudinal end portion of said photosensitive drum, wherein one and the other ends of the drum shaft are respectively supported on the first frame portion and the second frame portion of the cartridge frame, and wherein an area of said drum shaft on its outer peripheral surface adjacent the one end is engaged with a hole in said first frame portion and has projections and recesses thereon to increase friction with the hole; and (c) mounting on the drum shaft a preventing member for preventing the drum shaft from disengaging from the cartridge frame.

27. A method according to claim 26, wherein at least said one end of the drum shaft is press-fitted in the cartridge frame, and said other end is prevented from being disengaged by said preventing member.

28. A method according to claim 27, wherein the preventing member is in the form of a ring having an inside surface with an inward projection which is engaged with a groove formed on an outer periphery of said drum shaft when the preventing member is mounted on the drum shaft.

29. A method according to claim 26, wherein the preventing member is mounted on the drum shaft after said drum shaft inserting step.

30. A method according to claim 26, 27 or 28, wherein said first frame portion and said second frame portion are each provided with an outward projection from a side wall, wherein said projections have the holes, through which the one and the other end portions of the drum shaft are engaged in said drum shaft inserting step.

31. A method according to claim 30, wherein said photosensitive drum is provided with a spur gear at said one longitudinal end thereof and a helical gear at the other longitudinal end, and wherein when said process cartridge is mounted to the main assembly, said helical gear receives driving force from the main assembly to rotate said photosensitive drum, and transmits the driving fore to the developing member in the form of a developing roller, and wherein when said process cartridge is mounted to the main assembly, said spur gear transmits driving force to a transfer roller provided in said main assembly.

32. A method according to claim 30, further comprising a grounding member in the cylinder of said photosensitive drum, said grounding member being contacted to an inner surface of said cylinder and an outer surface of said drum shaft, wherein said grounding member electrically grounds said photosensitive drum to the main assembly through said drum shaft, and wherein said grounding member is mounted to said spur gear, wherein in said inserting step, the drum shaft is inserted through a hole formed in said spur gear and then penetrated through a hole formed in said helical gear to an outside.

33. A method according to claim 30, wherein said helical gear is provided with a through hole through which said drum shaft is penetrated, and said through hole is tapered, such that a diameter thereof decreases, from a drum shaft entrance side to the opposite side, wherein in said inserting step, the drum shaft is inserted along the tapered portion through a hole formed in said helical gear to an outside.

34. An assembling method for a process cartridge detachably mountable to a main assembly of an image forming apparatus, said process cartridge comprising an electrophotographic photosensitive drum having a cylinder and a photosensitive layer thereon;

a charging device for charging said photosensitive drum;

a developing member for developing a latent image formed on said photosensitive drum;

a cleaning member for removing residual toner from said photosensitive drum;

a cleaning frame for supporting the photosensitive drum, charging device and the cleaning member;

a developing frame for supporting the developing member and a toner container for containing toner to be used by the developing member, wherein said cleaning frame and said developing frame are rotatable relative to each other;

said method comprising:

(a) a disposing step of disposing the photosensitive drum between a side wall of a first frame portion and a side wall of a second frame portion of the cleaning frame, wherein said cleaning frame has a first projection outwardly projected from the side wall of the first frame portion at one longitudinal end of said photosensitive drum and a second projection outwardly projected from a side wall of a second frame portion at the other longitudinal end of said photosensitive drum, wherein said photosensitive drum is provided with a spur gear at the one end thereof and a helical gear at the other end, wherein the helical gear receives force for driving the photosensitive drum when said process cartridge is mounted to the main assembly and transmits driving force for driving a developing roller as the developing member to the developing roller, and wherein said spur gear transmits driving force for driving the transfer roller, provided in the main assembly of the apparatus, to the transfer roller;

(b) a drum shaft inserting step including inserting a drum shaft for rotatably supporting the photosensitive drum on said cleaning frame into a hole formed in the first projection, inserting the dram shaft into the cylinder through a hole formed in said spur gear, inserting the drum shaft to an outside of the cylinder through a hole of the helical gear, and inserting the drum shaft penetrating the photosensitive drum into a hole formed in the second projection, wherein one and the other end of the drum shaft are respectively supported on the first frame portion and the second frame portion of the cleaning frame by engagement with the holes formed in said first and second projections, and wherein an area of said drum shaft on its outer peripheral surface adjacent the one end is engaged with the hole in said first projection, and the area has projections and recesses thereon to increase friction with the hole; and (c) mounting on the drum shaft a preventing member for preventing the drum shaft from disengaging from the cleaning frame, wherein said preventing member is mounted to the drum shaft at the other end thereof longitudinally opposite the one end having the projections and recesses.

35. A method according to claim 34, wherein the preventing member is in the form of a ring having an inside surface with an inward projection which is engaged with a groove formed on an outer periphery of said drum shaft when the preventing member is mounted on the drum shaft.

36. A method according to claim 34, wherein the preventing member is mounted on the drum shaft after said drum shaft inserting step.

37. A method according to claim 34, further comprising a grounding member in the cylinder of said photosensitive drum, said grounding member being contacted to an inner surface of said cylinder and an outer surface of said drum shaft, wherein said grounding member electrically grounds said photosensitive drum to the main assembly through said drum shaft, and wherein said grounding member is mounted to said spur gear, wherein in said inserting step, the drum shaft is inserted through a hole formed in said spur gear and then penetrated through a hole formed in said helical gear to an outside.

38. A method according to claim 34, wherein said helical gear is provided with the hole through which said drum shaft is penetrated, and said hole is tapered, such that a diameter thereof decreases, from a drum shaft entrance side to an opposite side, wherein in said inserting step, the drum shaft is inserted along the tapered portion through the hole formed in said helical gear to an outside.

39. An assembling method for a process cartridge detachably mountable to a main assembly of an image forming apparatus, said process cartridge comprising an electrophotographic photosensitive drum having a cylinder and a photosensitive layer thereon;

a charging device for charging said photosensitive drum;

a developing member for developing a latent image formed on said photosensitive drum;

a cleaning member for removing residual toner from said photosensitive drum;

a cleaning frame for supporting the photosensitive drum, charging device and he cleaning member;

a developing frame for supporting the developing member and a toner container for containing toner to be used by the developing member, wherein said cleaning frame and said developing frame are rotatable relative to each other;

said method comprising:

(a) a disposing step of disposing the photosensitive drum between a side wall of a first frame portion and a side wall of a second frame portion of the cleaning frame, wherein said cleaning frame has a first projection outwardly projected from a side wall of the first frame portion at one longitudinal end of said photosensitive drum and a second projection outwardly projected from a side wall of the second frame portion at the other longitudinal end of said photosensitive drum, wherein said photosensitive drum is provided with a spur gear at the one end thereof and a helical gear at the other end, wherein the helical gear receives force for driving the photosensitive drum when said process cartridge is mounted to the main assembly and transmits driving force for driving the developing roller as the developing member to the developing roller, and wherein said spur gear transmits driving force for driving a transfer roller to the transfer roller, and wherein said helical gear is provided with a through hole through which a drum shaft is penetrated, and said hole is tapered such that a diameter thereof decreases from a drum shaft entrance side to an opposite side, and wherein said process cartridge further comprises a grounding member in the cylinder of said photosensitive drum, said grounding member being contacted to an inner surface of said cylinder and an outer surface of said drum shaft, wherein said grounding member electrically grounds said photosensitive drum to the main assembly through the drum shaft, and wherein said grounding member is mounted to said spur gear;

(b) a drum shaft inserting step including inserting the drum shaft for rotatably supporting the photosensitive drum on said cleaning frame into a hole formed in a first projection, inserting the drum shaft into the cylinder through a hole formed in said spur gear, inserting the drum shaft to an outside of the cylinder through the hole of the helical gear along the tapered portion, and inserting the drum shaft penetrating the photosensitive drum into a hole formed in the second projection, wherein one end and the other end of the drum shaft are respectively supported on the first frame portion and the second frame portion of the cleaning frame by engagement with the holes, formed in said first and second projection, and wherein an area of said drum shaft on its outer peripheral surface adjacent the one end is engaged with the hole in said first projection, and the area has projections and recesses thereon to increase friction with the hole; and (c) mounting on the drum shaft a preventing member for preventing the drum shaft from disengaging from the cartridge frame, wherein said preventing member is mounted to the drum shaft at the other end thereof longitudinally opposite the end having the projections and recesses, and wherein said preventing member is in the form of a ring having an inside surface with an inward projection which is engaged with a groove formed on an outer periphery of said drum shaft.

40. A method according to claim 39, wherein the preventing member is mounted on the drum shaft after said drum shaft inserting step.

41. An electrophotographic image forming apparatus, for forming an image on a recording material, to which a process cartridge is detachably mountable comprising:

means for detachably mounting a process cartridge which includes:

a cartridge frame having a hole for engaging one end of a drum shaft;

an electrophotographic photosensitive drum having a cylinder and a photosensitive layer thereon;

process means actable on said photosensitive drum;

a drum shaft for rotatably supporting said photosensitive drum on said cartridge frame, said drum shaft extending through said photosensitive drum and having a length sufficient to be supported by said cartridge frame at one end thereof and at the other end thereof, wherein an area of said drum shaft on its outer peripheral surface adjacent the one end is engaged with the hole in said cartridge frame and has projections and recesses thereon to increase friction with the hole;

a preventing member for preventing said drum shaft from disengaging from said cartridge frame; and said apparatus further comprising:

means for feeding the recording material.

42. An electrophotographic image forming apparatus, for forming an image on a recording material, to which a process cartridge is detachably mountable comprising:

means for detachably mounting a process cartridge which includes:

an electrophotographic photosensitive drum having a cylinder and a photosensitive layer thereon;

a charging device for charging said photosensitive drum;

a developing member for developing a latent image formed on said photosensitive drum;

a cleaning member for removing residual toner from said photosensitive drum;

a cleaning frame for supporting the photosensitive drum, charging device and the cleaning member;

a developing frame for supporting the developing member and a toner container for containing toner to be used by the developing member, wherein said cleaning frame and said developing frame are rotatable relative to each other;

a drum shaft for rotatably supporting said photosensitive drum on said cleaning frame, said drum shaft extending through said photosensitive drum and having a length sufficient to be supported by said cleaning frame at one end thereof and at the other end thereof, wherein projections and recesses are provided on said drum shaft on its outer peripheral surface adjacent the one end to increase friction when the one end is engaged with a hole in the frame of the cartridge;

a first projection projecting outwardly from a lateral wall of a first frame portion of said cleaning frame adjacent one longitudinal end of said photosensitive drum, said first projection having a hole with which the one end of said drum shaft is engaged a portion having the projections and recesses of;

a second projection projecting outwardly from a lateral wall of a second frame portion of said cleaning frame adjacent the other longitudinal end of said photosensitive drum, said second projection having a hole with which the other end of said drum shaft is engaged;

a preventing member for preventing said drum shaft from disengaging from said cleaning frame, wherein said one end of said drum shaft is press-fitted in said cartridge frame, and the other end thereof is prevented from disengaging from said cartridge frame by said preventing member;

wherein said photosensitive drum is provided with a spur gear at one longitudinal end thereof and a helical gear at the other longitudinal end, wherein said preventing member is located nearer to said other longitudinal end than said one longitudinal end, and wherein when said process cartridge is mounted to the main assembly, said helical gear receives driving force from the main assembly to rotate said photosensitive drum, and transmits the driving force to the developing member in the form of a developing roller, and wherein when said process cartridge is mounted to the main assembly, said spur gear transmits driving force to a transfer roller provided in said main assembly; and said apparatus further comprising:

means for feeding the recording material.

43. An electrophotographic image forming apparatus, for forming an image on a recording material, to which a process cartridge is detachably mountable comprising:

means for detachably mounting a process cartridge which includes:

an electrophotographic photosensitive drum having a cylinder and a photosensitive layer thereon;

a charging roller for charging said photosensitive drum;

a developing roller for developing a latent image formed on said photosensitive drum;

a cleaning blade for removing residual toner from said photosensitive drum;

a cleaning frame for supporting the photosensitive drum, charging roller and the cleaning blade, wherein said cleaning frame is formed of plastic resin material;

a developing frame for supporting the developing roller and a toner container for containing toner to be used by the developing roller, wherein said cleaning frame and said developing frame are rotatable relative to each other, and wherein said developing frame is of plastic resin material;

a drum shaft for rotatably supporting said photosensitive drum on said cleaning frame, said drum shaft extending through said photosensitive drum and having a length sufficient to be supported by said cleaning frame at one end thereof and at the other end thereof, wherein said drum shaft is formed of metal, and wherein projections and recesses are provided on said drum shaft on its outer peripheral surface adjacent the one end to increase friction when the one end is engaged with a hole in the cleaning frame;

a first projection projecting outwardly from a lateral wall of a first frame portion of said cleaning frame adjacent one longitudinal end of said photosensitive drum, said first projection having a hole with which the one end of said drum shaft is engaged, wherein when said process cartridge is mounted to the main assembly, said first projection is guided by a guide on the main assembly;

a second projection projecting outwardly from a lateral wall of a second frame portion of said cleaning frame adjacent the other longitudinal end of said photosensitive drum, said second projection having a hole with which the other end of said drum shaft is engaged, wherein when said process cartridge is mounted to the main assembly, said second projection is guided by a guide on the main assembly;

a preventing member for preventing said drum shaft from disengaging from said cleaning frame, wherein said preventing member is in the form of a ring having all inside surface with an inward projection which is engaged with a groove formed in an outer periphery of said drum shaft, wherein said one end of said drum shaft is press-fitted in said cleaning frame, and the other end thereof is prevented from disengaging from said cleaning frame by said preventing member, wherein said preventing member is formed of plastic resin material;

wherein said photosensitive drum is provided with a spur gear at one longitudinal end thereof and a helical gear at the other longitudinal end, wherein said preventing member is located nearer to said other longitudinal end than said one longitudinal end, and wherein when said process cartridge is mounted to the main assembly, said belical gear receives driving force from the main assembly to rotate said photosensitive drum, and transmits the driving force to the developing roller, and wherein when said process cartridge is mounted to the main assembly, said spur gear transmits driving force to a transfer roller provided in said main assembly; and said cartridge further comprises:

a grounding member in the cylinder of said photosensitive drum, said grounding member being contacted to an inner surface of said cylinder and an outer surface of said drum shaft, wherein said grounding member electrically grounds said photosensitive drum to the main assembly through said drum shaft, and wherein said grounding member is mounted to said spur gear; and said apparatus further comprising:

means for feeding the recording material.

44. A process cartridge according to claim 1, 17 or 23, wherein said projections and recesses are provided by knurling.

45. A method according to claim 26, 34 or 39, wherein said projections and recesses are provided by knurling.

46. An apparatus according to claim 41, 42 or 43, wherein said projections and recesses are provided by knurling.

* * * * *

UNITED STATES PATENT AND TRADEMARK OFFICE

CERTIFICATE OF CORRECTION

PATENT NO. : 5,878,310

DATED : March 2, 1999

INVENTOR(S) : SHINYA NODA, ET AL.

It is certified that error appears in the above-identified patent and that said Letters Patent is hereby corrected as shown below:

COLUMN 1

Line 65, "includes," should read --includes:--.

COLUMN 3

Line 26, "peripheral" should read --periphery--.
Line 41, "feeding." should read --feeding--.

COLUMN 4

Line 34, "portion-" should read --portion--.

COLUMN 5

Line 47, "approx." (second occurrence) should be deleted.
Line 64, "(FIG. 13)." should read --(FIG. 13)--.

UNITED STATES PATENT AND TRADEMARK OFFICE

CERTIFICATE OF CORRECTION

PATENT NO. : 5,878,310

DATED : March 2, 1999

INVENTOR(S) : SHINYA NODA, ET AL.

It is certified that error appears in the above-identified patent and that said Letters Patent is hereby corrected as shown below:

COLUMN 6

Line 6, "Gear" should read --Gears--.
Line 13, "7c," should read --7c--.
Line 23, "securedly" should read --securely--.
Line 53, "late" should read --plate--.

COLUMN 7

Line 31, "30," should read --30--.
Line 41, "dowels" should read --dowel--.
Line 52, "diameter" should read --diameter as--.
Line 62, "13a2," should read --13a2--.

COLUMN 8

Line 39, "approx." (second occurrence) should be deleted.
Line 64, "permit" should read --permits--.

COLUMN 9

Line 12, "sides" should read --side--.

UNITED STATES PATENT AND TRADEMARK OFFICE

CERTIFICATE OF CORRECTION

PATENT NO. : 5,878,310

DATED : March 2, 1999

INVENTOR(S) : SHINYA NODA, ET AL.

It is certified that error appears in the above-identified patent and that said Letters Patent is hereby corrected as shown below:

COLUMN 11

Line 13, "coated" should read --coated,--.

COLUMN 15

Line 48, "tus" should read --tus,--.
Line 49, "elertrophotographic" should read --electrophotographic--.

COLUMN 17

Line 59, "fore" should read --force--.

COLUMN 19

Line 48, "and he" should read --and the--.

UNITED STATES PATENT AND TRADEMARK OFFICE

CERTIFICATE OF CORRECTION

PATENT NO. : 5,878,310

DATED : March 2, 1999

INVENTOR(S) : SHINYA NODA, ET AL.

It is certified that error appears in the above-identified patent and that said Letters Patent is hereby corrected as shown below:

COLUMN 21

Line 44, "a" should read --of the--.
Line 45, delete "of".

COLUMN 22

Line 57, "all" should read --an--.

COLUMN 23

Line 4, "belical" should read --helical--.

Signed and Sealed this

Eighth Day of February, 2000

*Attest:*

Q. TODD DICKINSON

*Attesting Officer*

*Commissioner of Patents and Trademarks*